United States Patent [19]

Garza

[11] 4,196,605

[45] Apr. 8, 1980

[54] TUMBLER PIN-TYPE CYLINDER LOCK WITH AXIAL OR AXIAL AND RADIAL CYLINDER MOVEMENT

[76] Inventor: Roque V. Garza, Orozco y Berra 201-203 Sta., Ma la Ribera, Mexico

[21] Appl. No.: 957,018

[22] Filed: Nov. 2, 1978

Related U.S. Application Data

[63] Continuation-in-part of Ser. No. 923,356, Jul. 10, 1978, abandoned, which is a continuation of Ser. No. 780,994, Apr. 13, 1977, Pat. No. 4,099,395.

[30] Foreign Application Priority Data

Apr. 27, 1976 [MX] Mexico ..... 164449
Dec. 3, 1976 [MX] Mexico ..... 167256

[51] Int. Cl.[2] ..... E05B 27/06
[52] U.S. Cl. ..... 70/360
[58] Field of Search ..... 70/360, 357, 362, 361, 70/401, 407

[56] References Cited

U.S. PATENT DOCUMENTS

| | | | |
|---|---|---|---|
| 1,444,429 | 2/1923 | Rogginger | 70/360 |
| 2,910,860 | 11/1959 | Cambe | 70/360 |
| 3,863,475 | 2/1975 | Foss | 70/360 |
| 4,099,395 | 7/1978 | Garza | 70/360 |

*Primary Examiner*—Robert L. Wolfe
*Attorney, Agent, or Firm*—Harold L. Stowell

[57] ABSTRACT

A tumbler pin-type cylinder lock wherein the lock cylinder is mounted for controlled axial or axial and radial movement relative to the lock cylinder housing characterized in that the key and the cylinder have cooperating surfaces for axially shifting the cylinder toward the device actuating position. The cooperating surfaces comprise a conical depression on the lock cylinder and a cooperating pointed element at the inner end of the key. The conical depression is also characterized by having an opening in the center aligned with a counter bore extending axially through the cylinder.

7 Claims, 8 Drawing Figures

TUMBLER PIN-TYPE CYLINDER LOCK WITH AXIAL OR AXIAL AND RADIAL CYLINDER MOVEMENT

CROSS REFERENCE TO RELATED APPLICATION

This application is a continuation-in-part application of Application Ser. No. 923,356, filed July 10, 1978 and now abandoned, which is a continuation of Application of Ser. No. 780,994, filed Apr. 13, 1977, now U.S. Pat. No. 4,099,395, dated July 11, 1978.

BACKGROUND OF THE INVENTION

1. Field of Invention

This invention relates to improvements in tumbler pin-type cylinder locks which are provided with novel safety means which reduce the chances that the lock can be picked or rendered ineffective.

2. Description of the Prior Art

It is well established that experts in opening locks of the tumbler pin-type can relatively easily force with picklocks, locks which operate solely by rotating, radially the lock cylinder relative to the cylinder housing.

OBJECTS OF THE INVENTION

It is an object of the present invention to provide a tumbler pin-type cylinder lock wherein the cylinder must be moved axially or axially and radially in respect to the lock housing and movement of the lock cylinder in the axial direction is brought about by cooperating in a conical way the surfaces in the center bore of the lock cylinder and pointed element of the inner end of the key.

It is another object of the present invention to provide such a tumbler pin-type cylinder lock having a unique cylinder provided with various grooves which may be of plural depths to control electric, hydraulic, and/or mechanical locking controls.

It is a further object to provide such a lock provided with a cylinder which has a conical axial depression and a cooperating pointed element at the inner end of the key.

SUMMARY OF THE INVENTION

The hereinbefore objects and advantages of the present invention and others, which will be apparent to those skilled in the art, are generally provided by a tumbler pin-type cylinder lock comprising a housing having a cylinder bore therein, a plurality of tumbler pin bores in the housing normal to the cylinder bore and intersecting the same, a lock cylinder mounted in the cylinder bore for controlled movement relative to the housing, cylinder control tumbler pins mounted in the tumbler pin bores, a key having a profile conforming to the tumbler pin combination and a pointed stop member at the inner end of the key with the stop member engaging a cooperating conical depression on the lock cylinder for axially moving the cylinder within the cylinder bore in the lock housing.

BRIEF DESCRIPTION OF THE DRAWING

The invention will be more particularly described in reference to the accompanying drawing wherein.

DESCRIPTION OF PREFERRED EMBODIMENTS

Figure 1:
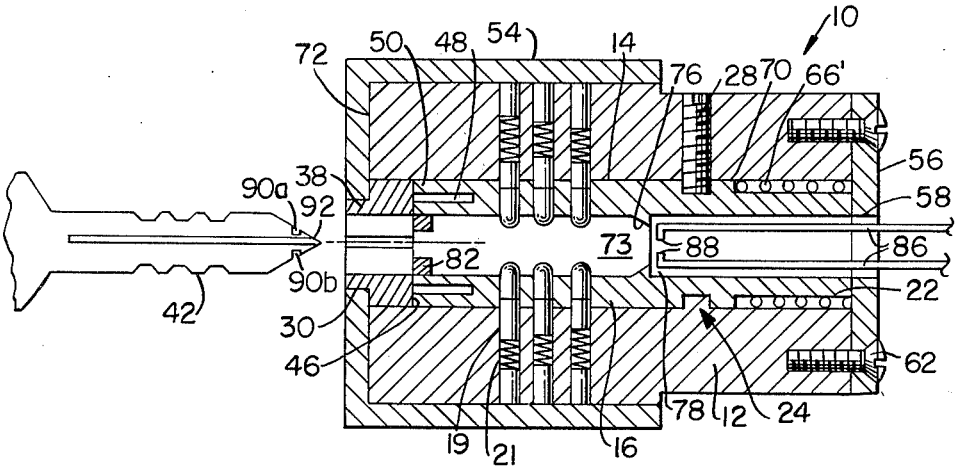
FIG. 1 is a partial sectional view through an improved tumbler pin-type cylinder lock constructed in accordance with the present invention.

Referring to the drawing and particularly FIGS. 1, 2, 3, and 4, 10 generally designates an improved tumbler pin-type cylinder lock embodying the features of the present invention useful in association with automotive ignition switch means, and a steering wheel lock mechanism as shown in my U.S. Pat. No. 4,099,395.

The lock 10 includes a cylinder housing 12, having a lock cylinder receiving bore 14 therein. Mounted within the bore 14 is a lock cylinder 16 mounted for both axial and radial movement relative to the cylinder housing 12.

The cylinder housing is provided with a plurality of bores designated 18*a, b,* and *c,* which bores are normal to the cylinder bore 14, and normal or opposed to each other as the case may be, and positioned to intersect said bore 14. The bores 18*a, b* and *c* receive tumbler pins 19 and tumbler pin springs 21. In the illustrated form of the invention, three banks of tumblers are illustrated, however, it will be appreciated that the invention includes tumbler locks wherein there are only one or only opposed or four banks of tumbler pins as is known in the art.

The cylinder 16 is provided with corresponding tumbler pin bores 20*a, b,* and *c,* which receive tumbler pins, again, all as known in the art. Between the tumbler pin bores 20*a, b* and *c,* and the shaped end 22 of the cylinder 16, the curvilinear surface of the cylinder is provided with a compound groove generally designated 24. The compound groove or slot is provided with a portion 24*a,* primarily directed in an axial direction and a portion 24*b,* primarily oriented in a radial direction relative to the longitudinal length of the cylinder 16.

Figures 2, 3, 4:
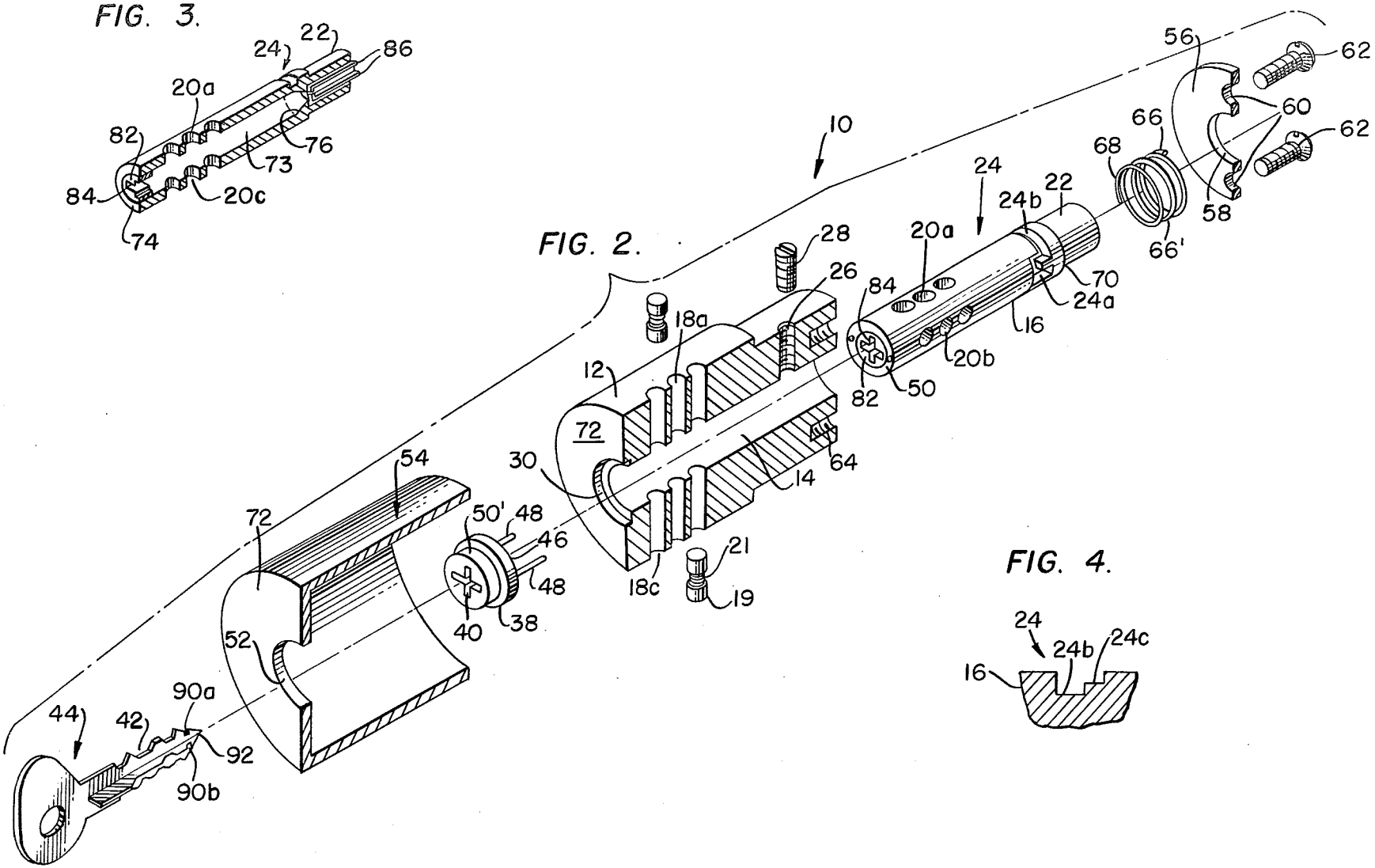
FIG. 2 is an exploded perspective, partial sectional view through the improved tumbler pin-type cylinder lock shown in FIG. 1.
FIG. 3 is a perspective, partial sectional view of the lock cylinder illustrated in FIG. 1.
FIG. 4 is a fragmentary transverse section of the cylinder showing the two-level pin groove.

It will be particularly noted from FIG. 4 that the groove generally designated 24 may be on two levels so that a plunger pin, not shown, activated by the upper groove 24*c* can operate a steering gear lock pin while motion of the cylinder is controlled by the fixed pin 28 in bore 26 in the lock housing 12.

The pin 28 may be of the type that is driven into the bore 26 after assembly of the lock, thus rendering it impossible to remove the cylinder 16 without boring the pin 28 therefrom or the pin may be just a snug fit or be provided with threads which cooperate with threads in the bore 26 so that the pin 28 may be readily removed by a locksmith.

The cylinder housing 12 is provided with a counter-bore 30, which counter-bore rotatably receives a circular protector plate 38. The protector plate is provided with an opening 40 therethrough of a size to receive the entire shank portion 42 of the key 44 as more clearly shown in FIG. 2 of the drawing. The protector plate 38 has secured to the inner face 46 thereof a pair of guide pins 48, which guide pins are slidably received in a pair of bores 50 extending in a longitudinal direction in the lock cylinder 16 so that the protector plate 38 will rotate with the lock cylinder 16 and the lock cylinder 16 may be moved longitudinally in respect to the protector plate 38. The protector plate 38 prevents a lock picker from urging the cylinder 16 inwardly in respect to the housing 12 by inserting a tool in the opening in the cylinder housing and forcibly driving the cylinder inwardly against the restraining effect of the tumbler pins received in the bores 18*a*–18*c*, and 20*a*–20*c*.

The reduced diameter portion 50' of the protector plate 38 is received in the bore 52 in the cover 54 which slides over the lock housing 12, and which housing is free to rotate in respect to the protector plate 38 and the entire lock.

The assembly also includes a plate 56 which is bored as at 58 to abut the forward end 22 of the cylinder 16.

The plate 56 is also bored at 60 to receive a pair of threaded connectors 62 which threaded connectors engage with internal threads in bores 64 in the lock housing 12.

The plate 56 also engages one end 66 of a helical compression spring 66' while the other end 68 of the spring engages the shoulder 70 of the lock cylinder 16 and constantly urges the cylinder toward the front end 72 of the lock housing 12. In operation of the lock the operator via the key 44, as to be more fully described hereinafter, moves the cylinder 16 against the urging of the spring 66'.

The cylinder 16 is provided with an internal axially extending bore 73 which extends from end 74 to adjacent the plural level track 24*b*. Adjacent the track 24*b* the bore is conical in configuration as at 76 and the tip of the conical bore is intercepted by a counter-bore 78 in end of portion 22 of the cylinder. Of course, as shown more clearly in FIGS. 1 and 3, key receiving slots extend from the bores radially outwardly as at 80. The forward end of the bore 72 is closed by a plug 82 which plug is provided with the slots 84 for reception of the key 44.

The bore 78 receives a pair of rods 86 having in-turned ends 88. The in-turned ends of the rods 86 are adapted to the received-in the end slots 90*a* and 90*b* in the cone shaped end 92 of the key shank 44 when the key is fully inserted in the lock cylinder 16. Once the key is engaged by the in-turned ends 88 of the rods 86 inward motion of the cylinder 16, as to be more fully described hereinafter, causes the rods 86 to be urged inwardly for control of bolts or other locking mechanisms or the like.

With the conical end 76 of the bore 72, insertion of a pick lock into the cylinder would be of a little avail as the pick lock would be forced by the tapered walls of the conical end 76 to pass through the opening into the counter-bore 78 and inward pressure would fail to move the cylinder 16 against the urging of the coil spring 66'.

Figure 5:
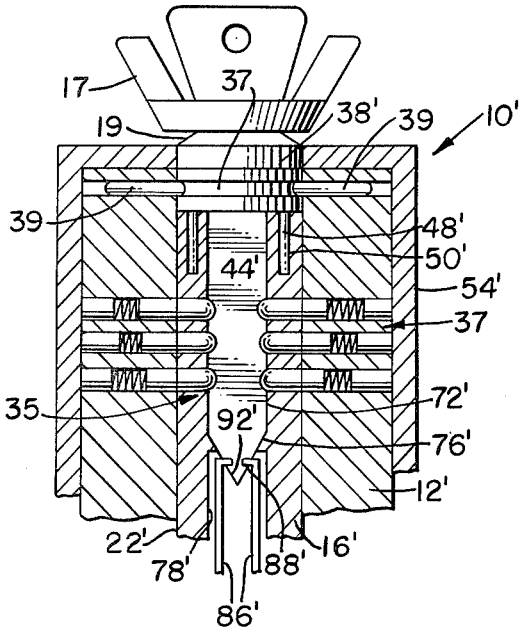
FIG. 5 is a fragmentary, partial, sectional view of a modified form of the present invention.

Referring now to FIG. 5 of the drawing a modified form of a lock constructed in accordance with the teachings of the present invention is illustrated wherein 10' depicts the lock, consisting of an outer housing or casing 54', a lock housing 12', a lock cylinder 16', and a winged actuator 17. The winged actuator 17 is connected to protector plate 38' which carries at its inner end a pair of pins 48' the ends of which are slidably received in bores 50', axially extending into the lock cylinder 16'. The protector plate 38' is provided with an angular groove 37 which groove receives the ends of screws or drive pins 39 whereby the protector plate 38' is free to rotate but can not be urged axially.

As in the prior form of the invention, the cylinder 16' has a bore 72' which terminates in a conical end 76' and the inner end of the conical bore 76' intersects a counter-bore 78' in the end or shank portion 22' of the cylinder 16'. Further, the lock assembly includes at least one set of cooperating bores and tumbler pin generally designated 35 and cooperating bores and pins 37 in the lock housing 12'.

The assembly also includes the rods 86' each having the in-turned end 88' which fit in lateral grooves in the tapered shank portion 92' of the key 44'.

The connection between the winged portion 17 and the protector plate 38' comprises a "joint of weakness" as at 19, whereby the lock cylinder 16' and the tumbler mechanism 35, 37, are positioned to permit rotation, however, a pick-lock attempting to rotate the lock cylinder 16' without a proper key 44' would shear the wing portion 17 from the protector plate 38' rendering the entire lock uncompromised but still in condition such that a proper party with the correct key 44' could cause the cylinder 16' to rotate the key itself.

Figure 6:
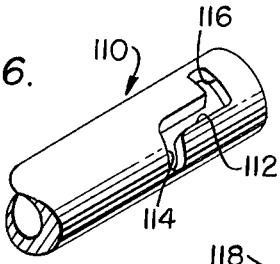
FIGS. 6 and 7 are fragmentary perspective views of modified forms of cylinder ends showing cavities or grooves differing from that shown in FIGS. 1–4; and, FIG. 8 is a fragmentary, perspective view of a cylinder and housing of a modified configuration.
Figure 7:
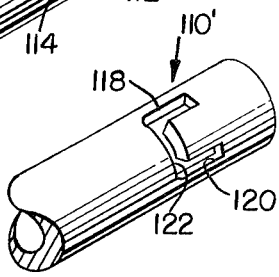

Referring now to FIGS. 6 and 7, various arrangements of grooves 110 and 110' are illustrated. For example, the groove 110 has a longitudinal movement portion 112 and a pair of arcuate portions 114 and 116, which are engaged by bin 28 [to permit operation of plural bolts or electrical contacts or electric/hydraulic mechanisms as desired.] Groove 110' of the form of the cylinder illustrated in FIG. 7 includes a pair of parallel axially extending grooves 118 and 120 and a single acruate groove 122 interconnecting the pair of axial grooves 118 and 120. Again the nature and configuration of the grooves is substantially unlimited as the cylinders of the locks of the present invention are mounted for both the radial and axial motion.

Figure 8:
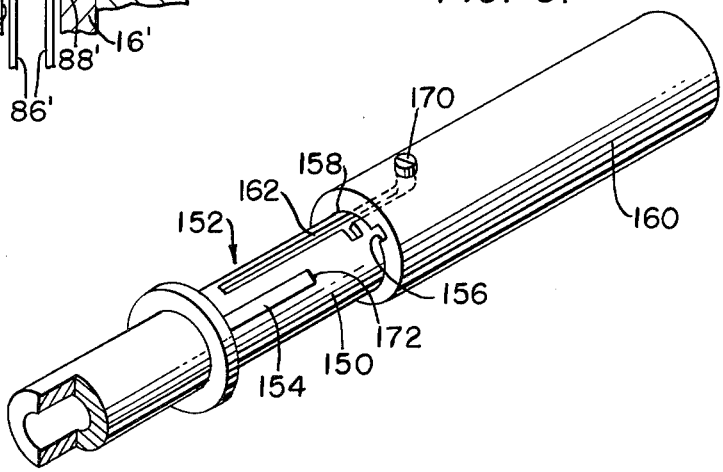

Referring now to FIG. 8, there is illustrated a form of the invention wherein a portion of the cylindrical surface 150 of the lock cylinder 152 is provided with an elongated upstanding rib 154 which rib is engagement with an elongated groove 156 milled in the inner bore 158 of the lock housing.

The cylindrical surface 150 is also provided with milled longitudinal and radial groove structures indicated at 162 which cooperate with the inner end of pin 170. The upstanding rib 154 helps to insure that there is no rotary motion between the cylinder 152 and housing 160 until a predetermined amount of longitudinal or axial movement of the cylinder 152 relative to the housing 160. It will be appreciated that when the cylinder 152 has been urged axially relative to the housing 160 a distance such that end 172 clears the lateral extension of the milled groove 156 it would then be possible to rotate the cylinder 156 via the groove 162 as guided by the pin 170.

From the foregoing description various forms of my invention has been specifically disclosed. However, it will be recognized by those skilled in the art that other and various specific constructures may be substituted for those illustrated in the drawing without departing the scope of the present invention.

I claim:

1. A tumbler pin-type cylinder lock comprising a housing having a cylindrical bore therein, a plurality of tumbler pin bores in the housing normal to the cylinder bore and intersecting the same, a lock cylinder mounted in the cylinder bore for controlled axial or axial and radial movement relative to the housing, a key receiving slot in the lock cylinder, cylinder control tumbler pins mounted in the tumbler pin bores, a key having a profile conforming to the tumbler pin combination and a pointed stop member at the inner end of the key, said stop member engaging a cooperating conical depression on the lock cylinder for axially moving the cylinder within the cylinder bore in the housing, said conical depression having an opening in the center thereof aligned with a counter bore extending axially through the cylinder.

2. The tumbler pin-type cylinder lock as defined in claim 1, wherein the pointed stop member at the inner end of the key is provided with at least one transverse notch and the counter-bore extending axially through the cylinder has mounted therein a draw pin engageable with the transverse notch.

3. The invention defined in claim 2 wherein there are a pair of draw bars in the counter-bore and the key has a pair of transverse notches.

4. The invention defined in claim 3 including spring means urging the lock cylinder in a direction remote from the conical depression.

5. The invention defined in claim 4 wherein the axial and radial movement of the cylinder within the cylinder housing is controlled by at least one pin mounted in a radial direction in the cylinder housing.

6. The invention defined in claim 5 wherein the cylinder is provided with a plurality of grooves which function to control motion of locking bolts.

7. The invention defined in claim 6 wherein there are at least a pair of opposed tumblers cooperating with the cylinder, the housing and the profile of the key.

* * * * *